United States Patent [19]

Fujita et al.

[11] 4,431,879

[45] Feb. 14, 1984

[54] ILLUMINATION-TYPE PUSHBUTTON SWITCH CONSTRUCTION

[75] Inventors: Yasushi Fujita; Hiroshi Sato, both of Tokyo, Japan

[73] Assignee: Nihon Kaiheiki Kogyo Kabushiki Kaisha, Tokyo, Japan

[21] Appl. No.: 425,368

[22] Filed: Sep. 28, 1982

[30] Foreign Application Priority Data

Oct. 6, 1981 [JP] Japan ..... 56-148403[U]
Jul. 1, 1982 [JP] Japan ..... 57-098217[U]

[51] Int. Cl.[3] ..... H01H 9/18
[52] U.S. Cl. ..... 200/314
[58] Field of Search ..... 200/314, 310, 313

[56] References Cited

U.S. PATENT DOCUMENTS

| | | | |
|---|---|---|---|
| 3,639,745 | 2/1972 | Shiki | 200/314 X |
| 3,819,895 | 6/1974 | Pittman et al. | 200/313 X |
| 3,849,621 | 11/1974 | Habecker | 200/310 |
| 4,301,344 | 11/1981 | Sakakino et al. | 200/314 |
| 4,354,074 | 10/1982 | Yoshimura | 200/314 |

*Primary Examiner*—John W. Shepperd
*Assistant Examiner*—Renee S. Kidorf
*Attorney, Agent, or Firm*—Lawrence I. Field

[57] ABSTRACT

Disclosed is an illumination-type pushbutton switch construction including an operation section slidably arranged in a switch housing and a switch operating section for actuating a switch section in cooperation with the operation section, wherein the operation section and the switch operating section are improved. The improved operation section includes a pushbutton, a switch actuating member detachably fitted with respect to the pushbutton and a supporting frame detachably attached to the switch actuating member, the supporting frame having a holding portion for holding a light emitting element. The improved switch operating section includes an actuating plate disposed so as to be slidable along the inner surface of the switch housing, the actuating plate being detachably attached to the switch actuating member, to thereby allow the pushbutton, switch actuating member, supporting frame and actuating plate to be connected in series and detachable from one another so as to be integrally movable.

18 Claims, 15 Drawing Figures

ILLUMINATION-TYPE PUSHBUTTON SWITCH CONSTRUCTION

BACKGROUND OF THE INVENTION

1. Field of the Invention

This invention relates to an improvement in an illumination-type pushbutton switch construction suitable for use in, for example, a terminal device of an electronic computer, a controlling board of a machine tool, a slot machine and the like.

More particularly, the present invention relates to an improved illumination-type pushbutton switch construction which is capable of ensuring the connection between a light emitting element having pin-like terminals disposed in a housing and a socket for securely inserting therein the pin-like terminals to prevent the pin-like terminals from being disconnected from the socket, to thereby accomplish the reliable operation; always keeping the distance between the illumination surface of the switch construction and the light emitting surface of the light emitting element constant irrespective of the state of a pushbutton to accomplish a stable illumination without any attenuation of light; allowing the pushbutton, the light emitting element and a switch actuating means for operating the switch to be easily replaced separate from one another, to thereby facilitate repairs and the like; effectively preventing the switch actuating means from being dislocated from the housing; and always keeping the distance between the illumination surface of the switch construction and the light emitting surface of the light emitting element constant even after the components have been replaced, to thereby accomplish a stable illumination without any attenuation of light.

2. Description of the Prior Art

Conventionally, there have been used two kinds of illumination-type switch constructions, one using an electric lamp having a screw cap and the other using an electric lamp which is lighted by flowing a current to a peripheral metal sheet thereof and the projected portion of a bottom thereof. However, the former switch construction has a disadvantage that the engagement between the screwed portion of the lamp and the switch is loosened due to vibration or the like to cause a contact failure, to thereby decrease reliability in operation, whereas, the latter switch construction has a disadvantage that the lamp is easily disconnected from a C-shaped socket due to vibration or impact.

In such conventional illumination-type switch construction, an illumination unit is generally fixed in a housing of the switch so that it may not move in the housing, as disclosed in Japanese Utility Model Application Laying-Open Publication No. 109225/1980. However, such structure causes a disadvantage that the distance between the illumination surface of the switch and the light emitting surface of a light emitting element is varied dependent on the position of a pushbutton to cause an attenuation of light, thus, it cannot accomplish a stable illumination.

In addition, in view of the durability and life of a switch section and/or in order to facilitate the incorporation of a pushbutton and the replacement of a light emitting element, a switch construction has been proposed which is constructed in such a manner that a switch section and an illumination section are fomred separate from each other. However, such conventional switch construction has a disadvantage that it is substantially impossible to smoothly and easily carry out the replacement of an illumination unit and an operation section including the pushbutton, a switch actuating means and the like.

Another switch construction of such type has been proposed which is constructed in such a manner to form the outer surface of a switch actuating means with guide pawls and engage the guide pawls with openings formed at the opposite side walls of a housing, to thereby prevent the switch actuating means from being dislocated from the housing. However, such conventional switch construction has a disadvantage that moisture, dust and the like enter into the housing through the openings of the housing, to thereby cause failure of the switch construction.

Further, each of the conventional switch constructions mentioned above has a disadvantage that it is highly difficult to replace the pushbutton and the switch actuating means when it is required to positionally change the light emitting element, for example, from the central portion of the pushbutton to the position deflected therefrom as desired.

BRIEF SUMMARY OF THE INVENTION

The present invention has been made in view of the foregoing disadvantages of the prior art.

Accordingly, it is an object of the present invention to provide an improved illumination-type pushbutton switch construction wherein a light emitting element having pin-like terminals is used to ensure the connection between the light emitting element and a socket by the pin-like terminals, to thereby effectively prevent the light emitting element from being disconnected from the socket due to vibration, impact or the like at the operation of the switch.

It is another object of the present invention to provide an improved illumination-type pushbutton switch construction which is capable of always keeping the distance between the illumination surface of the switch construction and the light emitting surface of a light emitting element constant irrespective of the position of a pushbutton to accomplish a stable illumination without any attenuation of light by movably disposing an illumination unit consisting of the light emitting element and a socket.

It is another object of the present invention to provide an improved illumination-type pushbutton switch construction which is capable of easily accomplishing the change in pushbuttons of different colors and light emitting elements of different operating voltages and the replacement of a light emitting element due to burnout or the like by engaging a light emitting element with at least one of a pushbutton and a switch actuating means forming an operation section, detachably fitting the pushbutton with respect to the switch actuating means and detachably fitting the switch actuating means with respect to an actuating plate, and connecting the pushbutton, switching actuating means and actuating plate in series to allow them to be integrally moved.

It is another object of the present invention to provide an improved illumination-type pushbutton switch construction wherein a switch section, a switch operating section and an illumination unit are formed substantially independent from one another; so that the replacement of one of these components may be easily carried out without affecting other components, the mounting or replacement of a light emitting element may be easily accomplished, the replacement of the pushbutton and switch actuating means may be easily attained when it is required to positionally change the light emitting element, for example, from the central portion of the pushbutton to the end portion thereof, and any desired combination of these components in such case of positionally changing the light emitting element may be easily carried out to significantly decrease the need of stocking these components.

It is a further object of the present invention to provide an improved illumination-type pushbutton switch construction which is capable of easily being assembled by only the steps of fitting a base member having a switch section arranged thereon with respect to the lower portion of a housing, connecting a switch actuating means to a switch actuating plate from the upward direction, and subsequently connecting a pushbutton to the switch actuating means.

It is still a further object of the present invention to provide an improved illumination-type pushbutton switch construction which is capable of effectively preventing a switch actuating means from being dislocated from a housing by engaging a switch actuating plate with the housing so as to allow the actuating plate to be moved only within a fixed stroke and engaging the switch actuating means with the actuating plate.

In accordance with the present invention, there is provided an illumination-type pushbutton switch construction comprising a housing having at least one open end, a switch section provided in the housing, an operation section slidably arranged in the housing in proximity to the open end of the housing, a switch operation section for actuating the switch section in cooperation with the operation section, an illumination unit disposed so as to be movable in the housing in response to the operation of the operation section, a terminal means for the illumination unit provided in the housing, and an electrically conductive bias means disposed between the illumination unit and the terminal means therefor.

In one preferred embodiment of the present invention, the illumination unit comprises a light emitting element having pin-like terminals and a socket for securely inserting therein the pin-like terminals of the light emitting element, and the operation section is provided with a holding portion which acts to prevent the light emitting element from being dislocated from the housing.

The operation section includes a pushbutton and the switch actuating means detachably fitted with respect to the pushbutton, the switch actuating means being further detachably connected to the switch operating section. This allows the pushbutton, switch actuating means and switch operating section being connected in series to be integrally movable and detachable from one another.

BRIEF DESCRIPTION OF THE DRAWINGS

Other objects and many of the attendant advantages of the present invention will be readily appreciated as the same becomes better understood by reference to the following detailed description when considered in connection with the accompanying drawings, in which like reference numerals designate the same parts throughout the figures thereof and wherein.

DETAILED DESCRIPTION OF THE PREFERRED EMBODIMENTS

Now, an illumination-type pushbutton switch construction according to the present invention will be hereinafter described in detail with reference to the accompanying drawings.

Figure 1:
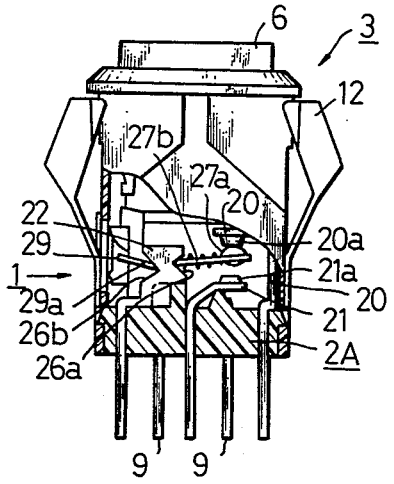
FIG. 1 is a partially cutaway sectional view showing the essential part of a first embodiment of an illumination-type pushbutton switch construction according to the present invention.
Figure 2:
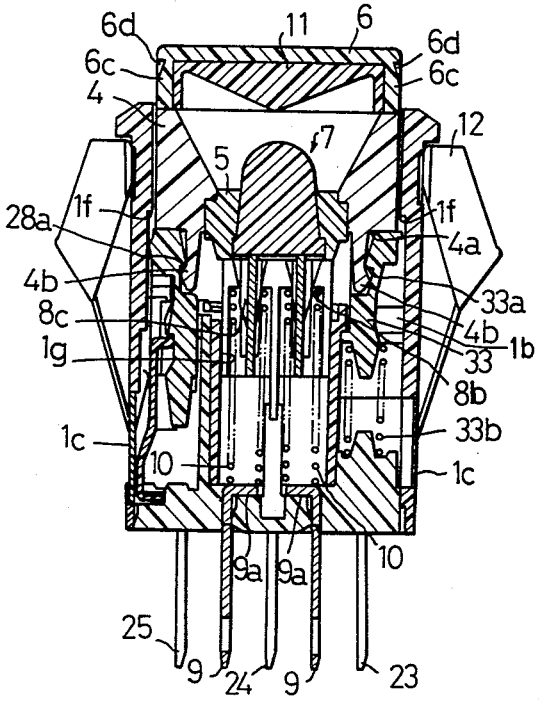
FIG. 2 is an enlarged view of the pushbutton switch construction shown in FIG. 1.
Figure 3:
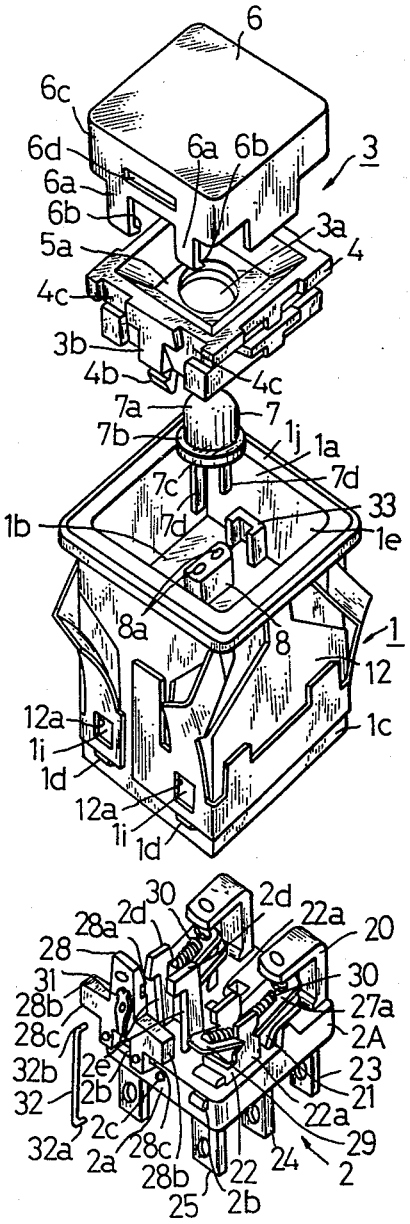
FIG. 3 is an exploded perspective view showing the essential portion of components of the pushbutton switch construction shown in FIG. 1.

FIGS. 1 to 3 illustrate a first embodiment of a pushbutton switch construction of the present invention. The pushbutton switch construction illustrated includes a housing section 1, a switch section 2 and an operation section 3. The housing section 1 is opened at the upper end portion 1*a* thereof and has a horizontal partition member 1*b* provided at the central portion thereof by which the housing section is divided into an upper chamber and a lower chamber. The partition member 1*b* is provided with a central opening (not shown) and side openings (not shown). The side opening is provided at both sides of the central opening and at the side end of the partition member 1*b*. At the portion of the central opening, the partition member 1*b* is further provided with a cylinder portion 1*g* at the lower surface thereof. Thus, a socket 8 hereinafter described is slidably inserted in the cylinder portion 1*g* through the central opening. One of the side openings receives therethrough an actuating plate 28 hereinafter described, and the other side opening receives therethrough a sliding plate 33 hereinafter described. The operation section 3 is received through the open end 1*a* of the housing section in the upper chamber to be slidable in the vertical direction. The switch section 2 is received in the lower chamber of the housing 1 through the lower open end portion 1*c* thereof. The operation section 3 includes a switch actuating means 4, a supporting frame 5 fitted with respect to the switch actuating means 4, and a pushbutton 6. The switch section 2 has a base member 2A on which switch elements detailedly described hereinafter are mounted and is fitted in the lower chamber of the housing 1 by engaging a plurality of recesses 1*d* formed at the lower open end 1*a* with the corresponding projections 2*b* formed on the side surfaces 2*a* of the base member 2A.

The switch section 2 includes a normally closed fixed member (hereinafter referred to as "NC fixed member") 20, a normally open fixed member (hereinafter referred to as "NO fixed member") 21 and a supporting member 22 having a pair of rising portions 22*a*, which are disposed on the base member 2A. The NC and NO fixed members 20 and 21 extend through the base member 2A in the downward direction to form NC and NO contact terminals 23 and 24, respectively. The supporting member 22 also downwardly extends through the base member 2A to form a common terminal 25. Each of the rising portion 22*a* of the supporting member 22 is formed at the both sides thereof with cutouts 26*a* and 26*b* (FIG. 1) in the vertical direction. The upper cutouts 26*a* are engaged with one end 27*b* of a first lever member 27 and the lower cutouts 26*b* are engaged with one end 29*a* of a second lever member 29 actuated by pressing an actuating plate 28 hereinafter described. Reference numeral 30 designates a spring of which the both ends are respectively fixed to the first and second lever members 27 and 29. The spring 30 acts to pivotably move the lever members 27 and 29 about the ends 27*b* and 29*a*, respectively, when the second lever member 29 is actuated by pressing the actuating plate 28 with respect to the member 29.

The actuating plate 28 acts to transmit the movement of the pushbutton 6 therethrough to the switch section 2. More particularly, the actuating plate 28 is attached to the base member 2A so as to be guided by the inner surface 1*e* of the housing 1 and the vertical portions 2*e* of rising members 2*d* mounted on the base member 2A so that it may be slidable in the vertical direction. Also, the actuating plate 28 has a recess 28*a* provided at the upper portion of the inner surface thereof, which is engaged with one of a pair of pawls 4*b* of the switch actuating means 4 through openings (not shown) of the partition member 1*b* to accomplish the mechanical connection of the actuating plate 28 with the operation section 3. The inner surface 1*e* of the housing 1 is formed with a step portion 1*f* which acts to prevent the actuating plate from being dislocated in the upward direction. The actuating plate 28 is formed with a heart-shaped cam 31 at the portion opposite to the inner surface 1*e* of the housing. Reference numeral 32 indicates a pin of which one bent end is inserted into a hole 2*c* formed at the side surface 2*a* of the base member 2A and the other bent end or free end 32*b* is movably fitted in the cam 31. Thus, the first lever member 27 is pivotably moved about the end portion 27*b* in the vertical direction to operate NC and NO contacts 20*a* and 21*a* through a movable contact 27*a* provided on the lever member 27. In this instance, the movable contact 27*a* is in the state of contacting with the NC contact 20*a* at the time when the actuating plate 28 abuts at the lower surfaces 28*c* of the horizontal arm portions 28*b* thereof against the second lever member 29 to start to force the second lever member 29 in the downward direction. Subsequently, when the actuating plate 28 further forces the lever member 29, the first lever member 27 is pivotably moved about the supporting point or end 27*b* to allow the movable contact 27*a* to contact with the NO contact 21*a*. As seen from the foregoing, an upward force is always applied to the horizontal arm portions 28*b* of the actuating plate 28 due to the moment generated by the positional relationship between the supporting points of the lever members 27 and 29 and the spring 30.

On the central portion of the base member 2A, terminals 9 for a light emitting element 7 are disposed which extend through the base member in the downward direction.

As described hereinbefore, the operation section 3 includes the switch actuating means 4, the supporting frame 5 formed separate from the actuating means 4, and the pushbutton 6 fitted in the actuating means 4 and supporting frame 5. The supporting frame 5 is mounted to the actuating means 4 and provided with a throughhole 3*a* which acts to hold the light emitting element 7 inserted therein from the downward direction. the switch actuating means, as mentioned above, is provided with one pair of the resilient pawls 4*b* opposite to each other and extending in the downward direction, one being resiliently engaged with the recess 28*a* of the actuating plate 28 and the other pawl being resiliently engaged with a recess 33*a* of a sliding plate 33 provided opposite to the actuating plate 28 as shown in FIG. 2. In addition, the actuating plate 28 is guided by the side surfaces 2*e* of the rising members 2*d* of the base member 2A as well as by the inner surface 1*e* of the housing 1 to be smoothly slidable in the vertical direction, as mentioned above. Furthermore, the pin 32 has the one bent end 32 securely inserted into the side hole 2*c* of the base member 2A and the other bent end or free end 32*b* inserted into the heart-shaped cam 31, so that the free end 32*b* may be slidably moved in the cam 31 to control the vertical movement of the actuating plate 28. Reference numeral 33*b* indicates a compression spring interposed between the sliding plate 33 and the base member 2A to allow the sliding plate 33 to be slided along a guide means (not shown) in the housing 1.

Thus, it will be noted that the upward force applied to the actuating plate 28 by the tension spring 30 and the upward force applied to the sliding plate 33 by the compression spring 33*b* cooperatively allow the switch actuating means 4 to be uniformly forced in the upward direction, resulting in the pushbutton 6 being smoothy slided in the housing 1.

Figure 4:
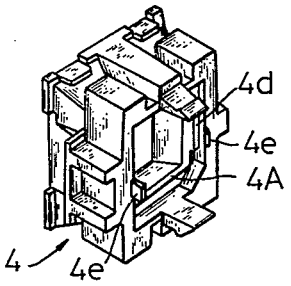
FIG. 4 is a perspective view showing a switch actuating means of the pushbutton switch construction shown in FIG. 1.
Figure 5:
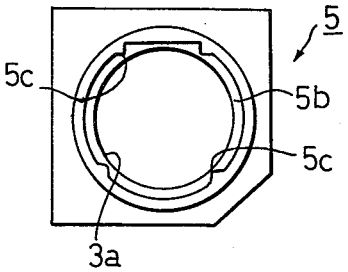
FIG. 5 is a bottom view showing a supporting frame of the pushbutton switch construction shown in FIG. 1.
Figure 6:
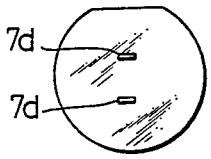
FIG. 6 is a bottom view showing a light emitting element of the pushbutton switch construction shown in FIG. 1.
Figure 7:
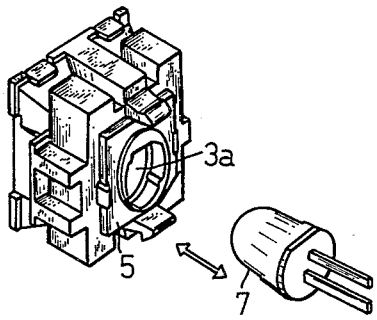
FIG. 7 is a view for explaining the manner of holding a light emitting element with respect to a supporting frame attached to a switch actuating means in the first embodiment shown in FIGS. 1 to 3.

As best seen in FIGS. 4 to 7, the switch actuating means 4 is opened at the upper and lower surfaces and the supporting member 5 having the hole 3*a* for holding the light emitting element 7 provided therethrough is attached to the lower surface of the switch actuating means 4. The supporting frame 5 is formed at the upper portion of each of the both sides thereof with recesses (not shown) and the switch actuating means 4 is formed at the lower portion of the inner surface thereof with a step 4A (FIG. 4). The step 4A is provided at the both sides wall portions thereof with projections 4*d*, above which a pair of downward extending elements 4*e* are provided. The attaching of the supporting member 5 to the switch actuating means 5 is accomplished by abutting the upper surface of the supporting member 5 against the step 4A of the switch actuating means 4 to securely fit the projections 4*d* of the step 4A in the recesses (not shown) of the supporting member 5. The through-hole 3*a* of the supporting member 5 is formed at the periphery thereof with an annular step 5*b*. The through-hole 3*a* is also provided with a plurality of projections 5*c* extending in the axial direction thereof between the lower end of the through-hole 3*a* and the annular step 5*b*. Thus, when the light emitting element 7 having a bottom shape as shown in FIG. 6 is inserted into the through-hole 3*a*, the supporting member 5 securely supports the element 7 therein.

Figure 8:
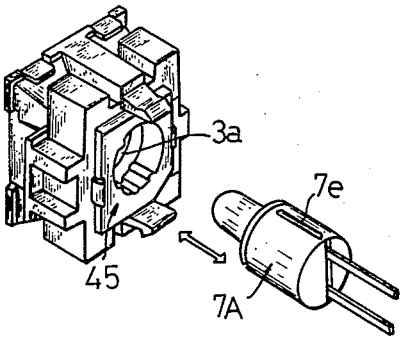
FIG. 8 is a view showing the manner of holding another example of a light emitting element with respect to another example of a supporting frame attached to a switch actuating means in the embodiment of FIGS. 1 to 3.
Figure 9:
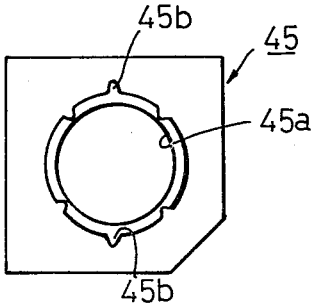
FIG. 9 is a bottom view showing a further example of a supporting frame.

FIGS. 8 and 9 show another supporting frame 45 suitable for supporting a light emitting element or lamp 7A having a shape as shown in FIG. 8 wherein the lamp 7A is provided at the periphery thereof with projections 7*e* extending in the longitudinal direction and a through-hole 45*a* of the supporting member 45 is formed at the inner surface thereof with recesses 45*b* which are to be engaged with the projections 7*e*.

The pushbutton 6 forming a part of the operation section 3, as shown in FIGS. 1 to 3, is mounted on the switch actuating means 4 by resiliently engaging pawls 6*b* formed at the lower end portions of leg members 6*a* downwardly extending from the both sides of one side surface of the pushbutton with recesses 4*c* formed at the switch actuating means 4. The pushbutton 6 has a lens 11 provided therein through which a light emitted from the element 7 is radiated from the upper surface of the pushbutton 6 to the exterior.

The supporting frame 5 securely supports therein the light emitting element 7 in a manner to project a light emitting portion 7*a* from the upper surface 5*a* of the supporting frame 5 and fit an annular portion 7*c* having a step 7*b* formed of an insulating material in the through-hole 3*a* of the supporting frame. The light emitting element 7 has two pin-like terminals 7*d* which project from the lower surface of the supporting frame 5 to extend in the housing 1. The light emitting element 7 suitable for use in the present invention includes any illuminants having pin-like terminals such as, for example, a light emitting diode, a miniature lamp having a filament, a neon glim lamp, and the like.

Figure 10:
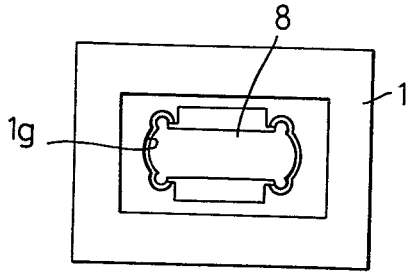
FIG. 10 is a schematic view of assistance in explaining the state that a socket of an illumination-type pushbutton switch construction of the present invention has been inserted in a cylindrical portion formed at a housing.

Below the light emitting element 7, a socket 8 shown in FIG. 10 is provided. The socket 8 is slidably inserted in a cylinder portion 1*g* formed in the housing 1 in a manner as shown in FIG. 2 which acts as a guide for an illumination unit consisting of the light emitting element 7 and the socket 8. Further, the socket 8 is upwardly forced by an electrically conductive compression coil spring 10. The socket is provided with a pair of through-holes 8*a* extending in the longitudinal direction thereof which receive therein the pin-like terminals 7*d* of the light emitting element 7. At the end of each of the through-holes 8*a*, the socket 8 is formed with a step 8*b* which is adapted to pressedly engage with the upper end of the compression spring 10. The socket 8 is made of an insulating material and has a metal fitment 8*c* inserted into the through-holes 8*a* in proximity to the steps 8*b*, the fitment 8*c* being adapted to contact with the pin-like terminals 7*d* and the spring 10 when the terminals 7*d* are downwardly inserted into the through-holes 8*a*. The spring 10 interposed between the socket 8 and the terminals 9 for the light emitting element 7 of which each one end is positioned in the housing 1 and the other end downwardly extends through the base member 2A to the exterior of the housing is disposed in such a manner that the upper end thereof pressedly contacts with the steps 8*b* of the socket 8 and the lower end thereof pressedly abuts against the end 9*a* of the terminals 9, to thereby accomplish an electrical connection between the light emitting element 7 and the terminals 9.

Thus, it will be noted that the embodiment illustrated is constructed in the manner such that, when the pushbutton 6 is downwardly pushed, the switch actuating means 4, supporting frame 5, light emitting element 7 and socket 8 are integrally moved in the downward direction. It is preferable to prevent the pushbutton 6 from being further pushed in the downward direction when the switch changing-over operation has been completed by applying a force to the pushbutton 6. This may be accomplished by engaging a step formed on the inner surface 1*e* of the housing 1 with a projection formed on the outer surface of any one of the pushbutton 6, the switch actuating means 4 and the supporting frame 5.

Reference numeral 12 designates a resilient plate having openings 12*a* which are fitted on projections 1*i* provided on the outer periphery of the housing 1. The resilient plate 12 and the flange portion 1*j* of the housing 1 cooperatively act to mount the pushbutton switch construction of the embodiment illustrated on a panel 34 (FIG. 11).

Figure 11:
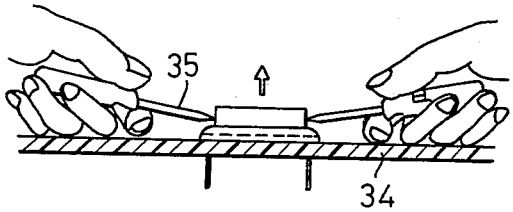
FIG. 11 is a schematic view showing the manner of removing an operation section from a switch body of a pushbutton switch construction of the present invention.

When it is required to remove the operation section 3 from the switch construction for the purpose of, for example, replacing parts after the switch construction has been attached to the panel 34, the removal can be easily carried out by applying a tool 35 such as a screw drive or the like to a pair of recesses 6*d* formed on the side surfaces 6*c* (FIGS. 2 and 3) of the pushbutton 6 and drawing up the operation section 3 while uniformly applying a force on the both sides thereof as shown in FIG. 11.

Figure 12A:
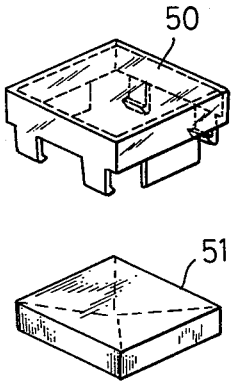
FIG. 12A is an exploded view showing another example of each of a pushbutton and a lens suitable for use in the present invention.

FIG. 12A shows a modification of the first embodiment mentioned above which includes a pushbutton 50 formed of a transparent material and a lens 51 colored red, yellow, green or the like so that it may accomplish an illumination of desired color by changing the lens 51.

Figure 12B:
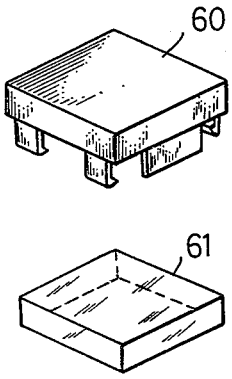
FIG. 12B is an exploded view showing another example of a pushbutton and a filter suitable for use in the present invention.

FIG. 12B shows another modification of the first embodiment wherein a pushbutton 60 is colored white, red, yellow, green or the like, and a transparent filter member 61 is substituted for the lens 51 in the above modification.

Figure 13:
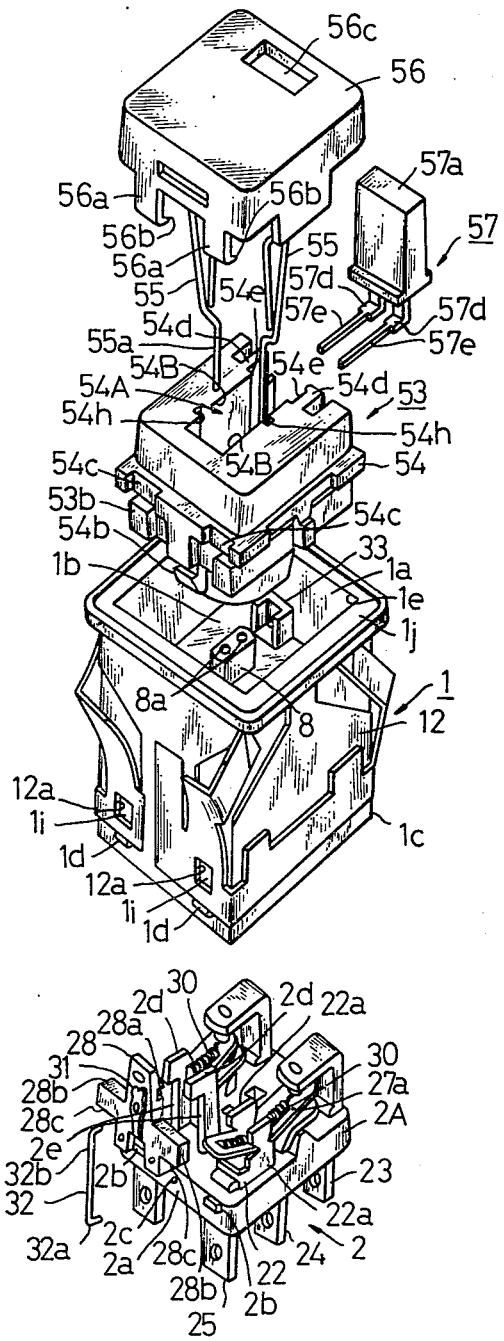
FIG. 13 is an exploded perspective view showing a second embodiment of an illumination-type pushbutton switch construction according to the present invention.

A second embodiment of an illumination-type pushbutton switch construction according to the present invention is illustrated in FIG. 13, which is adapted to arrange a light emitting element at the end portion of a pushbutton using a pushbutton, a light emitting element and a switch actuating means different from those of the first embodiment mentioned above. The second embodiment illustrated in FIG. 13 includes an operation section 53 comprising a switch actuating means 54 for actuating a switch section 2 and a pushbutton 56 formed separate from the switch actuating means 54 and fitted in the means 54. The switch actuating means 54 is formed with resilient pawls 54*b* downwardly extending from the lower end portions of the side surfaces thereof and opposite to each other, one pawl 54*b* being fixedly engaged with a recess 28*a* of an actuating plate 28 and the other pawl 54*b* being securely engaged with the step portion 33*a* of a sliding plate 33 in a similar manner to the first embodiment.

In the embodiment shown in FIG. 13, the switch actuating means 54 is formed at the substantially central portion thereof with a space 54A for receiving a light emitting element 57 and conductive terminals 55 thereof forming an illumination unit. More particularly, the space 54A is formed at the both sides of an inlet thereof with holding portions 54*d* for the light emitting element 57 which are provided with recesses 54*e* opposite to each other. Also, the space 54A is provided with lateral channels (not shown) for guiding L-shaped terminals 57*d* of the light emitting element 57 and is formed at the lower portion of the rear surface thereof with holes (not shown) for securely holding the free end portions 57*e* of the terminals 57*d* in order to prevent the light emitting element 57 from moving in the directions other than the upward direction. Further, the space 54A is provided at the side surfaces 54B thereof opposite to each other with vertical channels 54*h* for guiding and holding the conductive terminals 55 and at the central portion of the bottom surface thereof with through-holes (not shown) for introducing the leg portions 55*a* of the terminals 55 therethrough to the socket 8.

The pushbutton 56 forming a part of the operation section 53 is provided at the leg portions 56*a* thereof downwardly extending from the both sides thereof with pawls 56*b*, which are resiliently engaged with the recesses 54*c* of the switch actuating means 54 to allow the pushbutton 56 to be mounted in the switch actuating means. The pushbutton 56 is also provided at the position deflected from the central portion of the upper wall thereof with an aperture 56*c* through which the light emitting portion 57*a* of the element 57 is exposed to the exterior of the switch construction, this allowing a light emitted from the element 57 to be effectively radiated in the upward direction.

The light emitting element 57 is held with respect to the pushbutton 56 and switch actuating means 54 by fitting the light emitting portion 57*a* in the aperture 56*c* of the pushbutton 56 and fitting the element 57 in the space 54A of the switch actuating means 54 through the holding portions 54*d* having the recesses 54*e*. In this instance, the substantially L-shaped terminals 57*d* of the light emitting element 57 are resiliently supported by the conductive terminals 55, so that it is effectively contacted and held with respect to the terminals 55. The free ends 57*e* of the terminals 57, as mentioned above, are securely inserted into the holes (not shown) of the rear wall of the space 54A. In the second embodiment, any illuminants having terminals such as, for example, a light emitting diode, a miniature lamp, a neon glim lamp and the like can be used as the light emitting element 57, similar to the first embodiment.

Thus, it will be noted that the switch construction of the second embodiment is constructed in the manner such that the switch actuating means 54, conductive terminals 55, light emitting element 55 and the socket 8 are integrally moved in the downward direction when the pushbutton 56 is pushed downwardly. It is preferable to prevent the pushbutton 56 from being further pushed in the downward direction when the switch changing-over operation has been completed by applying a force to the pushbutton 56. This may be carried out by engaging a step formed on the inner surface 1*e* of a housing 1 with a projection formed on the outer surface of any one of the pushbutton 56, switch actuating means 54 and the supporting frame 54.

It will be easily understood that the switch construction of the second embodiment can be operated in the substantially same manner as the first embodiment.

Figure 14:
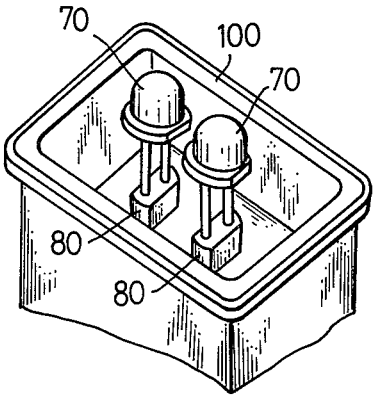
FIG. 14 is a perspective view showing a modification of the embodiment shown in FIG. 13 wherein two light emitting elements are used.

FIG. 14 shows a modification of the second embodiment wherein two light emitting elements 70 are provided. In FIG. 14, reference numerals 80 and 100 designate a socket and a housing, respectively.

In the first and second embodiments explained hereinbefore, the fitting of the pushbutton with respect to the switch actuating means is accomplished by engaging the projections of the pushbutton with the recesses of the switch actuating means. However, it is a matter of course that this may be carried out in the other way. This also is applied to the fitting between the switch actuating means and the operation section.

In the embodiments illustrated, the holding of the light emitting element with respect to the switch section is accomplished by means of the through-hole or stopper provided at the operation section. However, it is of course that this may be accomplished by any other means suitable for holding the light emitting element in position.

Further, in the embodiments illustrated, the guide means of allowing the illumination unit comprising the light emitting element and the socket to be moved in the housing in response to the operation of the operation section are provided at the housing. However, at least one rising member may be formed on the base member 2A as such guide means. Thus, it will be noted that the illumination unit can be smoothly guided in the housing by means of any suitable grooves or projections provided at the housing or base plate.

As seen from the foregoing, the present invention is constructed in the manner to upwardly force the illumination unit which comprises the light emitting element having the plural pin-like turminals and the socket by means of the conductive compression spring and hold the light emitting element in the housing by means of the operation section for actuating the switch section, to thereby resiliently support the illumination unit in the housing in the vertical direction. Also, in the present invention, the illumination unit is disposed to be movable in the housing in response to the operation of the operation section; thus, the present invention can effectively prevent the pin-like terminals of the light emitting element from being disconnected from the socket due to vibration or impact at the operation, to thereby ensure a reliability in operation. Furthermore, the present invention is capable of keeping the distance between the illuminating surface of the switch construction and the light emitting surface of the illumination unit constant, to thereby accomplish a stable illumination without any attenuation of light.

Also, the present invention has another advantage of allowing the pushbutton, the light emitting element disposed in the housing and the switch actuating means to be replaceable independent from one another and effectively preventing the dislocation of the switch actuating means from the housing. In addition, the present invention is capable of always keeping the distance between the illuminating surface of the switch construction and the light emitting surface of the illumination unit constant even if the components have been replaced.

Further, in the present invention, each of the switch section, operation section and light emitting element is formed as an independent unit; therefore, the removal of, for example, the switch actuating means does not require the disassemble of the switch section. The present invention is also capable of easily accomplishing the mounting and replacing of the light emitting element such as a light emitting diode, a miniature lamp or the like and independently accomplishing the replacement of the pushbutton and switch actuating means with ease in the case that the pushbutton is positionally changed from the central position of the switch construction to the side position thereof. In this instance, any combination of components of the switch construction can be accomplished as desired, to thereby eliminate the need of stocking various kinds of components.

The present invention has a further advantage capable of eliminating the need of providing extra openings and/or recesses on the outer wall of the housing, to thereby effectively prevent moisture, dust and the like from entering into the housing to ensure a reliability in operation.

Having described the invention as related to its preferred embodiments, it is intended that the invention be not limited by any of the details of description but rather be constructed broadly within its spirit and scope as set out in the appended claims.

Also, it is to be understood that the words which have been used are words of description rather than limitation.

What is claimed is:

1. An illumination-type pushbutton switch construction comprising:

a housing having at least one open end;

a switch section provided in said housing;

an operation section slidably arranged in said housing in proximity to said open end of said housing;

a switch operating section for actuating said switch section in cooperation with said operation section;

an illumination unit disposed so as to be movable in said housing in response to the operation of said operation section and including at least one light emitting element having pin-like terminals and a socket for securely inserting therein said pin-like terminals;

a terminal means for said illumination unit provided in said housing;

an electrically conductive bias means disposed between said illumination unit and said terminal means therefor; and wherein said operation section includes a pushbutton, a switch actuating means detachably fitted with respect to said pushbutton and a supporting frame detachably attached to said switch actuating means, said supporting frame having a holding portion for holding said light emitting element; and wherein said switch operating section includes an actuating plate disposed so as to be slidable along the inner surface of said housing, said actuating plate being detachably attached to said switch actuating means, to thereby allow said pushbutton, switch actuating means, supporting frame and actuating plate to be connected in series and detachable from one another so as to be integrally movable.

2. An illumination-type pushbutton switch construction as defined in claim 1, wherein said terminal means for said illumination unit has one end disposed in said housing and the other end extending to the exterior of said housing.

3. An illumination-type pushbutton switch construction as defined in claim 1, wherein said conductive bias means comprises a conductive compression coil spring, said compression coil spring acting to force said light emitting element of said illumination unit against said holding portion of said operation section.

4. An illumination-type pushbutton switch construction as defined in claim 3, wherein said socket is provided with through-holes in the longitudinal direction thereof which receive therein said pin-like terminals of said light emitting element and is formed at the end of said through-holes with step portions against which said compression coil spring abuts, said through-holes having inserted therein a socket metal fitment at the positions adjacent to said step portions and abutting on said pin-like terminals and compression coil spring.

5. An illumination-type pushbutton switch construction as defined in claim 1, wherein said actuating plate is engaged with the inner surface of said housing to move therealong only within the range of a predetermined stroke, so that said switch actuating means is prevented from being dislocated from said housing.

6. An illumination-type pushbutton switch construction as defined in claim 1, wherein said light emitting element includes a light emitting portion and an annular portion having a step formed of an insulating material, and said light emitting element is held with respect to said supporting frame by fitting said annular portion in said supporting frame.

7. An illumination-type pushbutton switch construction as defined in claim 1, wherein said housing further has a guide member provided therein which accomplishes said movement of the illumination unit in said housing, said guide member acting to guide said socket of the illumination unit therealong.

8. An illumination-type pushbutton switch construction comprising:

a housing having at least one open end;

a switch section provided in said housing;

an operation section slidably arranged in said housing in proximity to said open end of said housing;

a switch operating section for actuating said switch section in cooperation with said operation section;

an illumination unit disposed so as to be movable in said housing in response to the operation of said operation section and including at least one light emitting element having pin-like terminals and a socket for securely inserting therein said pin-like terminals;

a terminal means for said illumination unit provided in said housing;

an electrically conductive bias means disposed between said illumination unit and said terminal means therefor; and wherein said operation section has a holding portion provided therein which holds said light emitting element;

wherein said conductive bias means includes a conductive compression coil spring, said compression coil spring acting to force said light emitting element of said illumination unit against said holding portion of said operation section; and wherein said socket is provided with through-holes in the longitudinal direction thereof which receive therein said pin-like terminals of said light emitting element and is formed at the end of said through-holes with step portions against which said compression spring abuts, said through-holes having inserted therein a socket metal fitment at the positions adjacent to said step portions and abutting on said pin-like terminals and compression spring.

9. An illumination-type pushbutton switch construction as defined in claim 8, wherein said terminal means for said illumination unit has one end disposed in said housing and the other end extending to the exterior of said housing.

10. An illumination-type pushbutton switch construction as defined in claim 8, wherein said operation section includes a pushbutton, a switch actuating means detachably fitted with respect to said pushbutton and a supporting frame detachably attached to said switch actuating means, said supporting frame having said holding portion for holding said light emitting element.

11. An illumination-type pushbutton switch construction as defined in claim 10, wherein said switch operating section includes an actuating plate disposed so as to be slidable along the inner surface of said housing; said actuating plate being detachably attached to said switch actuating means, to thereby allow said pushbutton, switch actuating means, supporting frame and actuating plate to be connected in series and detachable from one another so as to be integrally movable.

12. An illumination-type pushbutton switch construction as defined in claim 10, wherein said light emitting element includes a light emitting portion and an annular portion having a step formed of an insulating material, and said light emitting element is held with respect to said supporting frame by fitting said annular portion in said supporting frame.

13. An illumination-type pushbutton switch construction as defined in claim 8, wherein said operation section includes a pushbutton and a switch actuating means detachably mounted with respect to said pushbutton, and said holding portion for said light emitting element is formed at said switch actuating means.

14. An illumination-type pushbutton switch construction as defined in claim 13, wherein said switch operating section includes an actuating plate disposed so as to be slidable along the inner surface of said housing, said actuating plate being detachably attached to said switch actuating means, to thereby allow said pushbutton, switch actuating means and actuating plate to be connected in series and detachable from one another so as to be integrally movable.

15. An illumination-type pushbutton switch construction as defined in claim 14, wherein said actuating plate is engaged with the inner surface of said housing to move therealong only within the range of a predetermined stroke, so that said switch actuating means is prevented from being dislocated from said housing.

16. An illumination-type pushbutton switch construction as defined in claim 8, wherein said housing further has a guide member provided therein which accomplishes said movement of the illumination unit in said housing, said guide member acting to guide said socket of the illumination unit therealong.

17. An illumination-type pushbutton switch construction comprising:

a housing having at least one open end;

a switch section provided in said housing;

an operation section slidably arranged in said housing in proximity to said open end of said housing;

a switch operating section for actuating said switch section in cooperation with said operation section;

an illumination unit disposed so as to be movable in said housing in response to the operation of said operation section and including at least one light emitting element having pin-like terminals and a socket for securely inserting therein said pin-like terminals;

a terminal means for said illumination unit provided in said housing;

an electrically conductive bias means disposed between said illumination unit and said terminal means therefor; and wherein said operation section has a holding portion provided therein which holds said light emitting element, said operation section further includes a pushbutton and a switch actuating means detachably mounted with respect to said pushbutton, and said holding portion for said light emitting element is formed at said switch actuating means; and wherein said switch operating section includes an actuating plate disposed so as to be slidable along the inner surface of said housing, said actuating plate being detachably attached to said switch actuating means, to thereby allow said pushbutton, switch actuating means and actuating plate to be connected in series and detachable from one another so as to be integrally movable.

18. An illumination-type pushbutton switch construction as defined in claim 17, wherein said actuating plate is engaged with the inner surface of said housing to move therealong only within the range of a predetermined stroke, so that said switch actuating means is prevented from being dislocated from said housing.

* * * * *